US005679182A

United States Patent [19]

Marder et al.

[11] Patent Number: 5,679,182

[45] Date of Patent: Oct. 21, 1997

[54] SEMI-SOLID PROCESSING OF BERYLLIUM-CONTAINING ALLOYS OF MAGNESIUM

[75] Inventors: James M. Marder, Shaker Heights; Warren J. Haws, Cleveland, both of Ohio

[73] Assignee: Brush Wellman Inc., Cleveland, Ohio

[21] Appl. No.: 313,994

[22] Filed: Sep. 28, 1994

Related U.S. Application Data

[62] Division of Ser. No. 184,867, Jan. 21, 1994, Pat. No. 5,413,644.

[51] Int. Cl.[6] ..... C22F 1/06; C22F 1/16

[52] U.S. Cl. ..... 148/665; 75/10.18; 148/666; 148/667; 164/113; 164/900; 420/590

[58] Field of Search ..... 148/665, 666, 148/667; 420/590; 75/10.18; 164/113, 900; 419/32

[56] References Cited

U.S. PATENT DOCUMENTS

| | | | |
|---|---|---|---|
| 4,229,210 | 10/1980 | Winter et al. | 75/10.14 |
| 4,434,837 | 3/1984 | Winter et al. | 164/468 |
| 4,482,012 | 11/1984 | Young et al. | 165/146 |
| 4,694,881 | 9/1987 | Busk | 164/113 |
| 4,694,882 | 9/1987 | Busk | 164/113 |
| 4,771,818 | 9/1988 | Kenney | 164/71.1 |
| 5,040,589 | 8/1991 | Bradley et al. | 164/113 |

*Primary Examiner*—David A. Simmons
*Assistant Examiner*—Robert R. Koehler
*Attorney, Agent, or Firm*—Hopgood, Calimafde, Kalil & Judlowe

[57] ABSTRACT

Disclosed is a practical magnesium based alloy containing 1 to 99 weight % beryllium and an improved method of semi-solid processing of magnesium alloys containing beryllium. The present method avoids agitation of molten alloys and the need for introducing shear forces by utilizing atomized or ground particles of beryllium mixed with solid, particulate or liquidus magnesium.

8 Claims, 3 Drawing Sheets

400X

ASSESSED Mg -Be PHASE DIAGRAM

SEMI-SOLID PROCESSING OF BERYLLIUM-CONTAINING ALLOYS OF MAGNESIUM

This is a divisional of U.S. patent application Ser. No. 08/184,867 filed Jan. 21, 1994 now U.S. Pat. No. 5,413,644.

BACKGROUND OF THE INVENTION

1. Field of Invention

The present invention relates to alloys of beryllium and magnesium. More particularly, the invention is a method of making alloys of magnesium containing beryllium and forming them into useful structural products.

2. Brief Description of the Prior Art

Currently, there are no known practical or useful structural alloys of beryllium and magnesium. Available information in the art reports the production of $MgBe_{13}$, a brittle intermetallic compound which cannot be used in any known practical manner (Stonehouse, *Distribution of Impurity Phases*, Beryllium Science & Tech., 1979, Vol. 1, pages 182–185). Commercially available beryllium ordinarily contains under 1000 ppm by weight magnesium as a residual component used in reducing $BeF_2$ in the normal refining process, and even this trace amount of magnesium is present as the intermetallic compound, $MgBe_{13}$ (Walsh, *Production of Metallic Beryllium*, Beryllium Science & Tech., 1979, Vol. 2, page 8).

Early research conducted at the Los Alamos Scientific Laboratory by F. H. Ellinger's group showed that reduction of $BeF_2$ with molten magnesium produced the intermetallic compound $MgBe_{13}$, and dilution of a pre-alloy of aluminum-beryllium with magnesium resulted in an overall mass largely in the form of $MgBe_{13}$ dendrites which was 34.4% beryllium (Elliott, *Preparation and Identification of $MgBe_{13}$*, Metallurgy and Ceramics, 13th Ed., 1958, pages 1–10). The British confirmed the shortcomings of intermetallic $MgBe_{13}$, made with porous beryllium powder infiltrated with molten magnesium, for their brittleness (Jones, *Preparation of Beryllium-Magnesium Alloys by Powder Metallurgical Methods*, United Kingdom Atomic Energy Authority Memorandum, 1961, AERE M 828). Jones observed that such alloys had structure consisting of a network of $MgBe_{13}$ surrounding grains of beryllium which contributed to the brittleness and high hardness.

The use of beryllium as a protective oxide during the processing of magnesium-rich master alloys is known. Such beryllium is used to prevent oxidation of the magnesium during transit and distribution to downstream processors. For instance, Brush Wellman Inc. of Elmore, Ohio, produces and distributes magnesium-rich pellets using 5% or less beryllium. Such pellets are made by hot-pressing powdered magnesium alloys together with powdered beryllium. The residual beryllium level in the downstream processors' final magnesium product is less than 0.01%.

Conventional semi-solid processing or thixo-forming of metals is a manufacturing method which takes advantage of low apparent viscosities obtained through continuous and vigorous stirring of heat-liquified metals during cooling (Brown, *Net-Shape Forming Via Semi-Solid Processing*, Advanced Materials & Processes, January 1993, pages 327–338). Various terminology is presently used to describe semi-solid processing of metals to form useful articles of manufacture, including such terms as rheo-casting, slurry-casting, thixo-forging and semi-solid forging. Each of these terms is associated with variations in the steps during semi-solid processing or in the types of equipment used.

Generally, semi-solid processing is initiated by first heating a metal or metals above their liquidus temperatures to form molten metal or alloy. Various methods known in the art are used to introduce shear forces into the liquified metals during slow cooling to form in situ, equiaxed particles dispersed within the melt. Under these conditions, the metals are said to be in a "thixotropic" or semi-solid slurry state. Thixotropic slurries are characterized by non-dendritic microstructure and can be handled with relative ease in mass production equipment allowing process automation and precision controls while increasing productivity of cast materials (Kenney, *Semisolid Metal Casting and Forging*, Metals Handbook, 9th Ed., 1988, Vol. 15, pages 327–338).

Non-dendritic microstructure of semi-solid metal slurries is described in Flemings U.S. Pat. No. 3,902,544. The method disclosed in this patent is representative of the state of the art which concentrates on vigorous convection during slow cooling to achieve the equiaxed particle dispersion leading to non-dendritic microstructure (Flemings, *Behavior of Metal Alloys in the Semisolid State*, Metallurgical Transactions, 1991, Vol. 22A, pages 957–981).

Published research prior to the present disclosure has focused on seeking an understanding of the magnitude of forces involved in deforming and fragmenting dendritic growth structures using high temperature shearing. It was discovered that semi-solid alloys displayed viscosities that rose to several hundreds, even thousands of poise depending on shear rates (Kenney, *Semisolid Metal Casting and Forging*, Metals Handbook, 9th Ed., 1988, Vol. 15, page 327), and that the viscosity of a semi-solid slurry, measured during continuous cooling, was a strong function of applied shear forces, such measured viscosities decreasing with increasing shear rate (Flemings, *Behavior of Metal Alloys in the Semi-Solid State*, ASM News, September 1991, pages 4–5).

Thus, subsequent commercial exploitation focused on developing different ways to agitate liquified metals, before or substantially contemporaneous to forming in a die, to achieve the roughly spherical or fine-grained microstructure in semi-solid slurry. Two general approaches to the forming process developed—(1) rheo-casting, in which slurry is produced in a separate mixer and delivered to a mold; and (2) semi-solid forging, in which a billet is cast in a mold equipped with a mixer which creates the spherical microstructure directly within the mold.

For example, Winter U.S. Pat. No. 4,229,210 discloses a method of inducing turbulent motion in cooling metals with electro-dynamic forces using a separate mixer, while Winter U.S. Pat. Nos. 4,434,837 and 4,457,355 disclose a mold equipped with a magneto-hydro-dynamic stirrer.

Various methods for agitating or stirring have been developed to introduce shear forces in the cooling metals to form semi-solid slurry. For example, Young U.S. Pat. No. 4,482,012, Dantzig U.S. Pat. No. 4,607,682 and Ashok U.S. Pat. No. 4,642,146 all describe means for electromagnetic agitation to produce the necessary shear forces within liquified metals. Mechanical stirring to produce the desired shear rates are described in Kenney U.S. Pat. No. 4,771,818, Gabathuler U.S. Pat. No. 5,186,236 and Collot U.S. Pat. No. 4,510,987.

Application of currently known semi-solid processing technology to alloys of magnesium containing beryllium is impractical because the melting point of beryllium is in excess of 1280° C. At such temperatures and under standard atmospheric conditions, magnesium vaporizes at a boiling point of 1100° C. (Elliott, *Preparation and Identification of $MgBe_{13}$*, Metallurgy and Ceramics, 13th Ed., 1958, pages 1–10). Currently known thixo-forming processes would require an initial high temperature liquidization of beryllium at above 1200° C. which would cause magnesium to boil away. This, in fact, is the commercially available process now used to remove magnesium impurities from beryllium during refining (Stonehouse, *Distribution of Impurity Phases*, Beryllium Science & Tech., 1979, Vol. 1, page 184).

The present disclosure describes solutions to the problems described above for making alloys of magnesium containing beryllium and further introduces a novel improvement in semi-solid processing for metal alloys.

OBJECTS OF THE INVENTION

Accordingly, it is an object of the present invention to provide practical magnesium-based alloys with beryllium additions in the range of 1 to 99% by weight.

It is another object of the present invention to provide practical beryllium-containing magnesium alloys that have a modulus of elasticity 100 to 400% greater than magnesium.

It is yet another object to provide a method for semi-solid processing which does not require heating to extremely high liquidus temperatures necessary for certain metals such as beryllium.

It is another object to provide a method for semi-solid processing which does not require introduction of shear forces.

Another object of the present invention is to provide a semi-solid process for magnesium alloys using 1 to 99% by weight powdered beryllium which eliminates the need for a fully liquid metal processing.

It is yet another object to provide a method by which precision, net shape magnesium components can be formed which contain significant amounts of beryllium.

It is a further object of the present invention to provide for alloys which have low densities close to that of magnesium combined with high modulus approaching that of beryllium.

Another object is to provide a technique for producing precision parts of magnesium-based alloys containing beryllium in the range between 1% to 99% by weight which avoids formation of deleterious magnesium-beryllium intermetallic compounds.

Other objects of the present invention will become apparent to those skilled in the art after a review of the following disclosure.

SUMMARY OF THE INVENTION

The present invention includes methods which provide practical master alloys of magnesium containing beryllium and means for making net shape magnesium-beryllium components which contain significant amounts of beryllium. The term "net shape" as used herein describes a component which is very near its final form, i.e. a precision casting that requires very little machining before it is put in service.

Referring to FIG. 1, the most recently accepted phase diagram for magnesium-beryllium alloys is provided (Nayeb-Hashemi, *The Beryllium-Magnesium System*, Alloy Phase Diagrams Monograph, ASM International, 1987, page 116). In comparison with phase diagrams for other alloy systems, the Mg—Be diagram is relatively incomplete, a reflection of the current state of the art which is limited in knowledge and experience for the Mg—Be system (Brophy, *Diffusion Couples and the Phase Diagram*, Thermodynamics of Structure, 1987, pages 91–95). However, the one clear feature present in the diagram illustrated in FIG. 1 is the prediction for the intermetallic compound $MgBe_{13}$ formation.

The present disclosure describes a novel use of solid beryllium particles dispersed in liquid or powder magnesium to produce beryllium-containing alloys of magnesium which surprisingly avoids formation of the deleterious intermetallic compound, $MgBe_{13}$, and which allows semi-solid processing of such novel beryllium-containing alloys of magnesium.

The presently claimed alloys have densities close to other known magnesium alloys combined with modulus of elasticity towards that of beryllium, such modulus increasing with increasing beryllium content. The modulus approaches that of a linear combination of the amount of magnesium at 6.6 million PSI and the amount of beryllium at 44 million PSI. This is consistent with the "rule of mixtures" concept found to be valid for predicting properties in aluminum-beryllium alloys which have similar structure.

The present alloys cannot be made by conventional ingot metallurgy or known atomization techniques, and the presently described method relies on combining beryllium in the form of solid particles with the magnesium in either liquid or solid form. The addition of solid beryllium particles, properly disbursed in liquid or powder magnesium to produce the required mixture of materials without formation of the intermetallic compound is described and claimed uniquely by the present disclosure. The following table summarizes the properties of the various beryllium-containing magnesium alloys made pursuant to the present invention.

TABLE I

AZ-91D/Be Alloy Property Comparison

| Be (Wt %) | Density (lb/in$^3$) | Modulus (MSI) | E/Rho (in × $10^6$) | CTE (in/in/°F. × $10^{-6}$) |
|---|---|---|---|---|
| 0 | 0.065 | 6.5 | 99.6 | 14.5 |
| 5 | 0.065 | 8.3 | 127.6 | 14.1 |
| 10 | 0.065 | 10.2 | 155.6 | 13.7 |
| 15 | 0.065 | 12.0 | 183.6 | 13.3 |
| 20 | 0.066 | 13.9 | 211.6 | 12.9 |
| 25 | 0.066 | 15.7 | 239.6 | 12.5 |
| 30 | 0.066 | 17.6 | 267.6 | 12.1 |
| 35 | 0.066 | 19.4 | 295.6 | 11.7 |
| 40 | 0.066 | 21.3 | 323.6 | 11.3 |
| 45 | 0.066 | 23.2 | 351.6 | 10.9 |
| 50 | 0.066 | 25.0 | 379.6 | 10.5 |
| 62 | 0.066 | 29.6 | 446.8 | 9.5 |
| 70 | 0.066 | 32.6 | 491.6 | 8.9 |
| 80 | 0.066 | 36.4 | 547.6 | 8.5 |
| 90 | 0.067 | 40.2 | 603.6 | 7.2 |
| 100 | 0.067 | 44.0 | 659.7 | 6.4 |

Since the starting material is a mixture of two powders and there is no apparent tendency for the two powders to separate during the process, alloy compositions from 1% to 99% beryllium balance magnesium can be made. One of the strongest market requirements is the desire to have magnesium based alloys with higher elastic modulus and no increases in density.

As indicated in Table I, a continuous variation of properties from those of the magnesium alloy at one extreme to beryllium at the other is achieved. For example, a 5% beryllium increment produces a 28% higher modulus at the same density compared to the magnesium alloy base. Thus, at least 25% higher modulus can be achieved with a minimum of 5% beryllium addition to magnesium-based alloys pursuant to the presently disclosed method.

In the preferred embodiment of the present invention, spherical beryllium powder, produced preferably through an atomization process from liquid beryllium, is mixed with magnesium in powder, chip or other coarsely divided form. Spherical beryllium powder was made via inert gas atomization, a technique well known to those skilled in the art. The use of atomized beryllium is preferred in the presently disclosed semi-solid processing because the spherical shape of the particles improves flow during shaping and also provides less erosion of the surfaces of the equipment used.

Other methods for making beryllium powder are described in Stonehouse, *Distribution of Impurity Phases*, Beryllium Science & Tech., 1979, Vol. 1, pages 182–184, which is incorporated by reference herein. Ground beryllium is also applicable in conjunction with or as an alternative to spherical beryllium powder. Ground beryllium is ordinarily produced through impact grinding such as the Coldstream process, well known by those skilled in the art. These and other standard methods of comminuting beryllium powder applicable in the practice of this invention are available in the art such as in Marder, *P/M Lightweight Metals*, Metals Handbook, 9th Ed., 1984, Vol. 7, pages 755–763; Stonehouse and Marder, *Beryllium*, ASM International Metals Handbook, 10th Ed., 1990, Vol. 2, pages 683–687; and Ferrera, *Rocky Flats Beryllium Powder Production*, United Kingdom Atomic Energy Authority Memorandum, 1984, Vol. 2, JOWOG 22/M20, which are all incorporated by reference herein. In all cases, the beryllium starting material used in the research associated with the above publications was provided by Brush Wellman Inc., Elmore, Ohio.

Commercial purity magnesium and magnesium alloy powders are available from such sources as the Reade Manufacturing Co. of Lakehurst, N.J., which supplies a magnesium based alloy containing 9% aluminum and 1% zinc referred to in the art as AZ-91D. Other known magnesium products including commercially pure magnesium are equally amenable to processing by the present method such as those available from the Dow Chemical Co., Midland, Mich.

In the preferred embodiment, a solid mixture of spherical beryllium powder and magnesium in chip form is heated to a temperature such that only the magnesium based components melt (typically above 650° C.), which results in a suspension of beryllium powder particles in the magnesium liquid. Thus, a semi-solid slurry of Mg—Be is obtained without elevation to temperature extremes, and non-dendritic microstructure is achieved without introducing external shear forces into molten liquid.

FIG. 2 is a photomicrograph showing the desirable, non-dendritic beryllium portion in a compound-free structure of a magnesium-beryllium alloy made by vacuum hot pressing magnesium alloy powder and equiaxed beryllium powder at above 650° C. pursuant to the present method. The structure shown in FIG. 2 is useful for direct engineering applications such as solidifying in place to make a component part, or can be subjected to conventional metal working processes such as subsequent rolling, forging or extruding.

The structure shown in FIG. 2 can also serve as a precursor for semi-solid processing to produce net shape parts. FIG. 3 is a photomicrograph showing the desirable structure after semi-solid processing of the magnesium-beryllium alloy whose microstructure is shown by FIG. 2. This process did not involve any shear processing such as stirring prior to solidification. In both FIGS. 2 and 3, the structures are shown to be free of the undesirable intermetallic compound. Thixotropic mixtures with structures similar to those illustrated in FIG. 3 are injected or molded, using suitably modified extrusion or die-casting equipment. Typically, such processes are carried out in devices similar to those used for injection molding of plastic.

Conventional semi-solid processing is divided into two major portions (1) the raw material preparation step needed to develop the proper starting microstructure, and (2) the semi-solid shaping step. Unlike known methods, the presently disclosed process does not require conventional raw material preparation steps because the proper structure is immediately and automatically achieved by starting with two powder components heated above the solidus temperature of only one of the components.

There is little to no terminal solubility of the beryllium in the magnesium, or magnesium in beryllium. Therefore, the processing temperature of the material to be thixotropically formed via the unique semi-solid processes of the present invention, remains equal to or less than the liquidus temperature of the magnesium-rich component (650° C.). This permits use of equipment made with less complex and relatively inexpensive engineering materials which do not need to withstand the extreme temperatures necessary to melt beryllium.

The processing temperature selected is determined by the desired volume fraction of solid materials in the slurry. The net amount of solid present in slurry is established by the amount of solid beryllium added plus the solid portion (if any) of the partially molten magnesium component.

The low temperatures practiced with the present method also limits the formation of the intermetallic compounds of magnesium and beryllium. If elements such as aluminum are added to the magnesium, further reducing the working temperature, any remaining, potential reactivity of the magnesium with beryllium is virtually eliminated. These innovative concepts allow for net-shaped semi-solid processing of magnesium-beryllium alloys at the low temperatures typical of magnesium products.

The two generally known approaches to semi-solid shaping are (1) thixotropic forging (semi-solid forging), whereby the alloy work piece is shaped by squeezing in a closed die or flowed by a plunger into a permanent mold cavity; and (2) thixotropic casting (semi-solid molding), whereby the semi-solid metal is transported to a permanent mold cavity by a rotating auger feed stroke. Both of these processes are compatible with the present invention as demonstrated in the examples below.

DETAILED DESCRIPTION OF THE INVENTION

Figure 1:
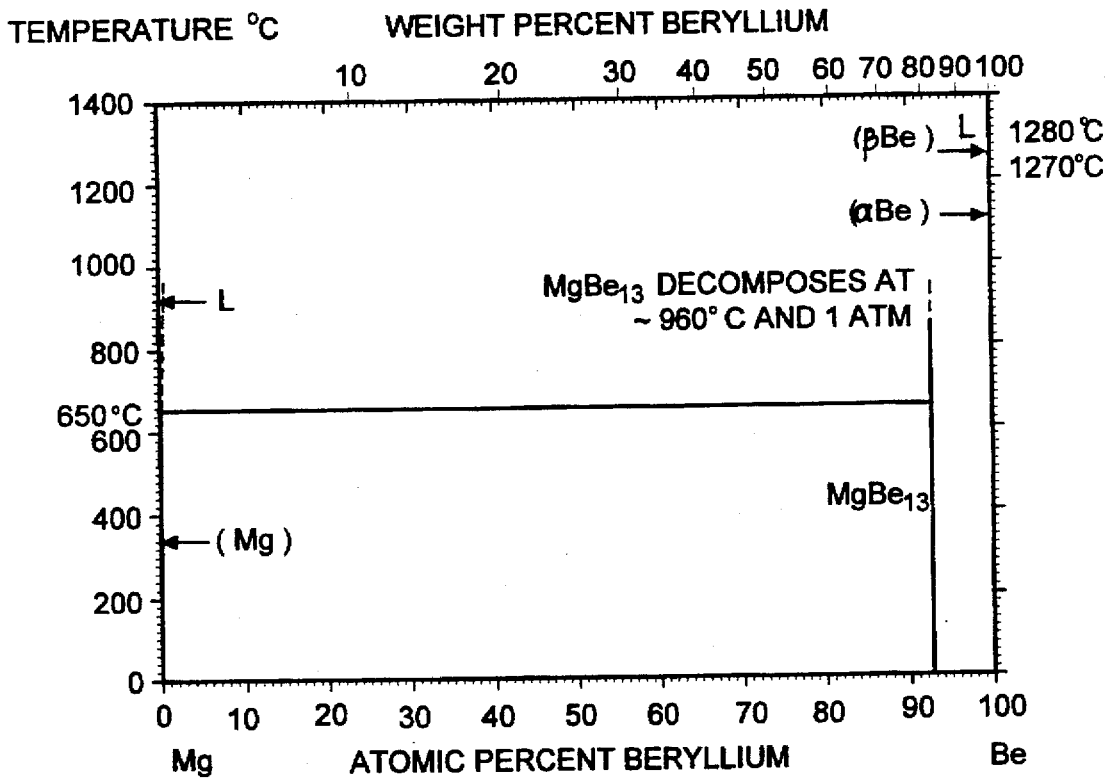
FIG. 1 is a current magnesium-beryllium phase diagram.

The trials outlined in Examples 1–7 below were conducted to produce net shape castings of magnesium alloys containing additions of solid beryllium powder. Such magnesium-beryllium alloys were produced from the semi-solid state using (1) the thixomolding™ process; (2) in situ freezing; and (3) closed die forging. The examples clearly demonstrate that thixotropic forming of a magnesium based alloy with solid beryllium additions is feasible without externally introduced shear forces.

All environmental health and safety equipment, including supplementary HEPAVAC ventilation, were installed prior to the initiation of trials. Air counts were taken periodically during the trials and the final clean-up operation. All participants wore suitable air filter masks and clothing during the trials (further safety details available from Brush Wellman Inc., Cleveland, Ohio).

Thixomolding is a semi-solid molding process developed by the Thixomat Corporation, Ann Arbor, Mich., under license for U.S. Pat. Nos. 4,694,881, 4,694,882 and 5,040,589, all assigned to the Dow Chemical Company, Midland, Mich. These patents disclose a method and apparatus for injection molding metal alloys and are incorporated by reference herein. As stated in the Background section, the current art, including the teachings of these three patents, requires the addition of shear forces into substantially liquified metals to produce the necessary non-dendritic microstructure. Apparatus associated with the Thixomolding process were modified for the trials in Examples 1–5, but those portions of the Thixomolding process involving introduction of shear forces into liquidus metals for generating non-dendritic microstructure were not applied.

EXAMPLE 1

Preparation of Starting Materials

The base material used was a magnesium-rich composition designated, AZ-91D, and the beryllium was added as S-200F powder. Magnesium feedstock was Thixomag AZ-91D in chip form provided by Dow Magnesium of Freeport, Tex. The following table lists the composition for AZ-91D.

TABLE II

AZ-91D Nominal Composition

| Element | Weight Percent |
|---|---|
| Aluminum | 8.5–9.5 |
| Beryllium | 0.0004–0.001 |
| Zinc | 0.5–0.9 |
| Copper | 0.00–0.01 |
| Nickel | 0.00–0.001 |
| Silicon | 0.00–0.02 |
| Manganese | 0.17–0.32 |
| Iron | 0.000–0.004 |
| All Others | 0.01 max. |
| Magnesium | Balance |

Beryllium was added as chips made from a 60% beryllium vacuum hot pressing. The vacuum hot pressing was made from −200 mesh AZ-91D powder provided by Reade Manufacturing Co., Lakehurst, N.J., and S-200F impact ground beryllium powder, available from Brush Wellman Inc., Elmore, Ohio.

The powders were blended for 10 minutes in a 10 cubic foot capacity double cone blender. Vacuum hot pressing was carried out at 1050° F. (566° C.) for 4–6 hours achieving a density of 86% of theoretical. The pressing was skinned to remove any carbon contamination from the pressing dies and machined into chips. The chips from the 62% beryllium pressing were diluted with Thixomag AZ-91D chips to produce lower beryllium content alloys. These were roll blended at the Thixomat Corporation, Racine, Wis.

EXAMPLE 2

Initial Trial

The process was first stabilized for AZ-91D without beryllium additions. Temperatures along the barrel and auger were typical of those used for AZ-91D, with a nozzle temperature of about 1070° F. (577° C.). When the process had achieved steady state, an addition of beryllium-bearing chips was made to the input material hopper. The first addition consisted of approximately 44 pounds (lbs.) of undiluted 60% beryllium feed stock added to approximately 15 lbs. of Thixomag in the hopper, resulting in an overly enriched feed which quickly stalled the system. Raising the temperature above the liquidus of the AZ-91D did not free the screw.

After disassembly, it was found that the flutes of the feedscrew and the non-return valve were plugged with almost pure beryllium powder. Metallographic analysis revealed that a significant portion of the beryllium in the castings made prior to the machine stall was in the form of agglomerates, caused by interlocking of particles under high pressure and an excessive beryllium powder loading. A replacement screw was installed, the machine re-aligned and trials were continued.

EXAMPLE 3

Second Trial As in the first trial, the process was stabilized with AZ-91D input material prior to the addition of beryllium to the system. The temperatures of all various zones were kept above the liquidus for AZ-91D, 1107° F. (597° C.). After 30 full shots of Thixomag only, the feeder was turned off, and the machine was operated to clear the system. After the barrel was empty, 25.5 lbs. of 30% beryllium and 9.5 lbs. of pure Thixomag was added to the hopper, which contained an estimated 16 lbs. of Thixomag. This resulted in a fully diluted beryllium content of 15% by weight. The feeder was restarted and, after 10 shots, full castings were made. Over 20 full castings were made before auxiliary equipment maintenance required system shut down for the day.

EXAMPLE 4

Third Trial

A normal start-up was made, with the residual 15 weight % beryllium material in the hopper. After 30 full shots, 25 pounds of 30 weight % material was added to the hopper, for an estimated 22–28 weight % beryllium product depending upon the effectiveness of the hopper mixing system. At shot number 58, 19.5 additional pounds (lbs.) of 30 weight % material was added to the hopper. After 5 shots, the screw pressure began to build. Several full castings were made, but difficulties in feeding chips and in feeding the casting were noted. A nozzle temperature of 1130° F. (610° C.) was used, but the material plugged the nozzle, as it had in the first trial. The run was terminated and the alloy subsequently analyzed to be about 12.5% beryllium.

The success achieved at the 12.5% beryllium level was significant. It demonstrated the feasibility of the process and provided direction for further improvement. The performance advantage of this alloy level in mechanical applications can be understood from the data in Table I (Summary section). At the 12.5% beryllium level the elastic modulus is approximately 13.5 million psi which represents approximately a 70% improvement over magnesium while retaining comparable density and coefficient of thermal expansion.

EXAMPLE 5

Thin Section Casting

The same mold used in Example 4 provided a thin section cavity to test the ability of the present semi-solid alloy to fill and produce low width parts. It was found that samples as thin as 0.019 inches were successfully produced under the same conditions used in Example 4. Metallography of the finished parts indicate approximately same composition as the relatively bulkier castings in Example 4, i.e., a uniform distribution of the beryllium phase within the magnesium alloy matrix showing that thin precision components are within the capability of the present process.

EXAMPLE 6

In-situ Freezing from the Semi-solid State

Figure 2:
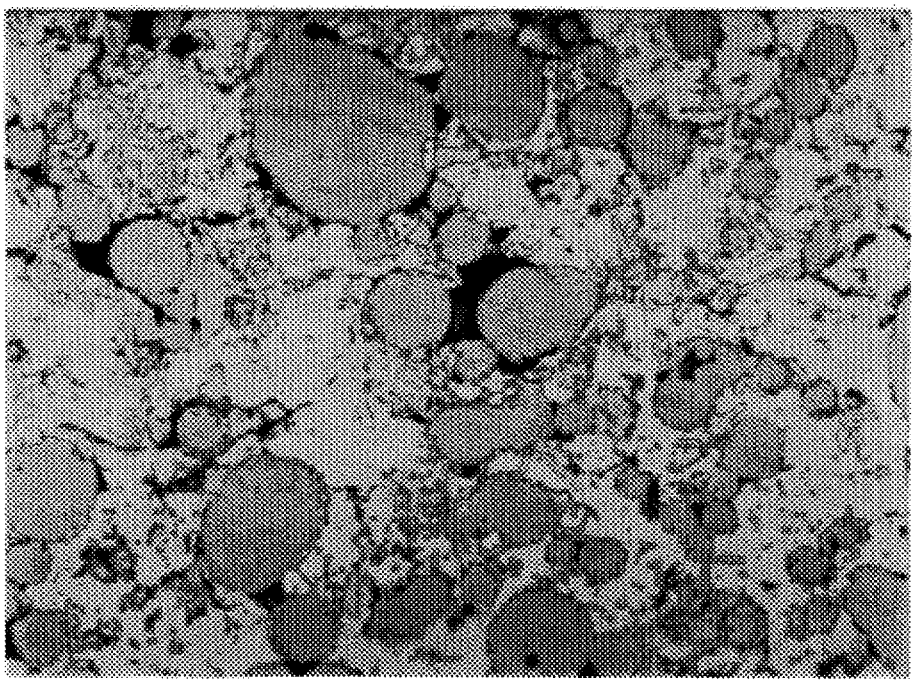
FIG. 2 is a photomicrograph depicting non-dendritic microstructure in the beryllium portion of a magnesium-beryllium alloy obtained via the present method.

FIG. 2 shows non-dendritic microstructure with a prominent absence of $MgBe_{13}$ intermetallic compound in a magnesium-beryllium alloy solidified in place after vacuum hot pressing magnesium alloy powder and equiaxed beryllium powder. The non-dendritic structure was achieved without introduction of shear forces because the second phase (beryllium) remained solid during the entire process.

The structure described in FIG. 2 was made with a powder blend of 40% by weight atomized beryllium (–200 mesh) and 60% by weight magnesium alloy, AZ-91D (–325 mesh) was heated in vacuum at 1100° F. (593° C.) such that only the magnesium alloy melted, with pressure applied to compact the semi-solid slurry. This alloy was used as a precursor for semi-solid processing as outlined below in Example 7.

EXAMPLE 7

Closed Die Forging

Figure 3:
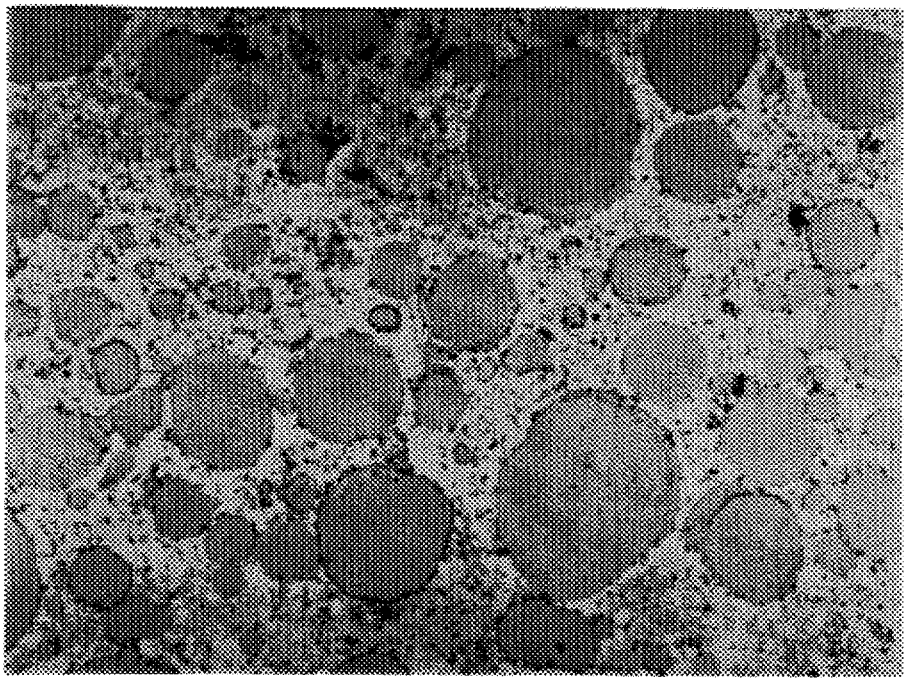
FIG. 3 is a photomicrograph showing non-dendritic microstructure in the beryllium portion after semi-solid processing of the magnesium-beryllium alloy whose structure is illustrated by FIG. 2.

FIG. 3 shows that even after semi-solid forging, the non-dendritic microstructure with absent $MgBe_{13}$ intermetallic compound is preserved for the magnesium-beryllium alloy made in Example 6. Like the process of Example 6, the semi-solid forging here did not require external shear force introduction.

Solid Mg—Be billets were machined from the precursor made in Example 6. The billets were then heated to 1050° F. (566° C.) in a furnace using argon gas as a protective atmosphere against oxidation. The preheated billets were transferred into dies using tongs and then injected into closed cavities where they solidified. FIG. 3 illustrates the resulting microstructure after the injection/forging process. The size and shape of the beryllium phase have not altered as a result of the additional processing since the beryllium remains solid during the entire process.

EXAMPLE 8

Processing of Magnesium Alloys

This example shows fabrication of a component part made of magnesium or a magnesium-aluminum alloy with beryllium using standard powder metallurgy techniques followed by standard processing. First, magnesium powder is mixed with 40% weight impact ground beryllium powder. This mixture is then placed into a neoprene or other flexible cylindrical container of about 6.5 inches in diameter, and cold isostatically pressed at a pressure of 40 ksi to achieve a compact which has about 20% porosity. The flexible container is then removed, and the compact of magnesium and beryllium placed into a copper cylindrical can for extrusion.

The can is attached by a suitable fitting to a vacuum pump, then air and other gasses are removed from the powder and can, followed by sealing of the evacuated can. Extrusion through a die at a temperature in the range of 300°–600° F., to a final extruded diameter of 1.5 inches fully consolidates the mixed and cold isostatically pressed powders into a solid bar, ready for machining into a finished component. Referring to Table III, the properties of the fully dense bar stock has an elastic modulus of 21.2 million psi, and a density of 0.0646 lbs. per cubic inch.

Alternatively, following extrusion through a die at a temperature in the range of 300°–600° F. to a final extruded diameter of 1.5 inches, the bar is cut to provide lengths of 2 to 3 in. These smaller bars are heated to a temperature of 1120° F. and semi-solid forged to a net shape part. The properties of the fully dense forging results in an elastic modulus of 21.2 million psi, and a density of 0.0646 lbs. per cubic inch.

TABLE III

Mg/Be Alloy Property Comparison

| Be (Wt %) | Density ($lb/in^3$) | Modulus (MSI) | E/Rho ($in \times 10^6$) | CTE ($in/in/°F. \times 10^{-6}$) |
|---|---|---|---|---|
| 0 | 0.063 | 6.4 | 102.0 | 14.0 |
| 5 | 0.063 | 8.2 | 129.9 | 13.6 |
| 10 | 0.063 | 10.0 | 157.8 | 13.3 |
| 15 | 0.063 | 11.8 | 185.7 | 12.9 |
| 20 | 0.063 | 13.6 | 213.5 | 12.6 |
| 25 | 0.064 | 15.4 | 241.4 | 12.2 |
| 30 | 0.064 | 17.2 | 269.3 | 11.8 |
| 35 | 0.064 | 19.0 | 297.2 | 11.4 |
| 40 | 0.064 | 20.9 | 325.1 | 11.1 |
| 45 | 0.064 | 22.8 | 353.0 | 10.7 |
| 50 | 0.065 | 24.6 | 380.8 | 10.3 |
| 62 | 0.065 | 29.2 | 447.7 | 9.4 |
| 70 | 0.065 | 32.2 | 492.4 | 8.8 |
| 80 | 0.066 | 36.1 | 548.1 | 8.0 |
| 90 | 0.066 | 40.0 | 603.9 | 7.2 |
| 100 | 0.067 | 44.0 | 659.7 | 6.4 |

EXAMPLE 9

Semi-solid Processing of Magnesium Alloys

This example summarizes how component parts are made using modified semi-solid processing with mixed powders followed by hot isostatic pressing to attain full density, followed by conventional forging to fabricate a shape.

Magnesium powder is mixed with 40% weight beryllium powder, and loaded into a vacuum hot pressing die. Vacuum hot pressing is then carried out at a temperature of 1120° F., and a pressure of 1000 psi to achieve a density of 95% of theoretical (5% Porosity).

The billet is then placed into a hot isostatic press, and pressed at 15 ksi and a temperature of 850° F. to achieve full density. The resulting part is then forged at a temperature at which it was fully solid, such as 850° F., and machined to final components, with properties similar to those listed in Table III and stated in Example 8.

Alternatively, parts can be made via modified semi-solid processing of mixed powders followed by hot isostatic pressing to attain full density, followed by semi-solid forging to fabricate a shape. After vacuum hot pressing at 1120° F., and a pressure of 1000 psi to achieve a density of 95% of theoretical (5% Porosity), the billet is then forged in the semi-solid state, at 1050° F. to a near net shape, with properties similar to those given in Table III.

Useful component parts can be readily fabricated through conventional processing by modifying the present method of mixing the magnesium or magnesium alloy powder with beryllium powder. Therefore, mixed powders, consolidated by standard powder metallurgy techniques such as vacuum hot pressing (VHP), hot isostatic pressing (HIP) or extrusion, provide useful material of the desired composition for fabrication into components.

Semi-solid state processing is not necessarily required to make components of magnesium or magnesium alloy/beryllium parts pursuant to the present method. If conventional semi-solid processes are modified for use, the mixed powders of magnesium or magnesium alloy and beryllium must only be processed below the temperature at which the intermetallic compound forms during processing. This temperature lies above the melting point of magnesium and most magnesium alloys.

Subsequent to preparation of the alloy, the consolidated material is processed as follows:

(i) machining of a final part directly from the billet made by conventional mixing and consolidation of powders;

(ii) conventional (fully solid) forging of a part from the billet made by conventional mixing and consolidation of powders;

(iii) conventional (fully solid) extrusion of a part from the billet made by conventional mixing and consolidation of powders; or (iv) conventional (fully solid) rolling of a part from the billet made by conventional mixing and consolidation of powders.

Pre-forms of magnesium alloy containing beryllium fabricated by vacuum hot pressing, hot isostatic pressing or other powder consolidation methods are further processed in subsequent conventional metal fabrication methods, as indicated in (a) through (d), below, or in subsequent semi-solid processing operations (e) through (g), indicated below:

(a) machining of a final part directly from the billet fabricated by semi-solid processing;

(b) conventional (fully solid) forging of a part from the billet fabricated by semi-solid processing;

(c) conventional (fully solid) extrusion of a part from the billet made by semi-solid processing;

(d) conventional (fully solid) rolling of a part from the billet made by semi-solid processing;

(e) thixotropic forging (semi-solid forging, plunger method);

(f) Thixomolding, thixotropic casting (semi-solid molding, auger method); and (g) thixotropic (semi-solid) extrusion.

Various modifications and alterations to the present invention may be appreciated based on a review of this disclosure. These changes and additions are intended to be within the scope and spirit of this invention as defined by the following claims.

What is claimed is:

1. A method for making a magnesium alloy containing beryllium, said alloy being free of intermetallic $MgBe_{13}$ compounds, said method comprising the steps of:

(a) providing a magnesium component in powder form and a beryllium component in powder form;

(b) mixing said magnesium and beryllium components; and (c) melting said magnesium component at a temperature above approximately the solidus temperature of magnesium.

2. The method of claim 1, wherein said beryllium component is equiaxed, solid beryllium dispersed in said magnesium component.

3. The method of claim 2, wherein said equiaxed, solid beryllium is selected from the group consisting of mechanically ground powder beryllium and atomized, spherical powder beryllium.

4. The method of claim 1, wherein said magnesium component is substantially pure magnesium.

5. The method of claim 1, wherein said magnesium component is a magnesium-rich composition.

6. The method of claim 1, wherein said melting step is a process selected from the group consisting of vacuum hot pressing, hot isostatic pressing and extrusion.

7. The method of claim 1 further comprising steps selected from the group consisting of closed die forging, semi-solid forging and semi-solid molding.

8. A method for making a magnesium alloy containing beryllium, said alloy being free of intermetallic $MgBe_{13}$ compounds, said method comprising the steps of:

(a) providing a magnesium component in powder form and a beryllium component in powder form;

(b) mixing said magnesium and beryllium components;

(c) melting said magnesium component at a temperature above approximately the solidus temperature of magnesium to create a semi-solid slurry of solid beryllium dispersed in liquid magnesium; and (d) in situ casting of the semi-solid slurry from step (c).

* * * * *